US008275143B2

(12) United States Patent
Johnson

(10) Patent No.: US 8,275,143 B2
(45) Date of Patent: Sep. 25, 2012

(54) AUDIO SYSTEM

(75) Inventor: Eleanor Johnson, Durham (GB)

(73) Assignee: Ameeca Limited, Lanchester, Durham (GB)

( * ) Notice: Subject to any disclaimer, the term of this patent is extended or adjusted under 35 U.S.C. 154(b) by 1166 days.

(21) Appl. No.: 12/084,178

(22) PCT Filed: Oct. 27, 2006

(86) PCT No.: PCT/GB2006/050355

§ 371 (c)(1),
(2), (4) Date: Apr. 25, 2008

(87) PCT Pub. No.: WO2007/049075

PCT Pub. Date: May 3, 2007

(65) Prior Publication Data

US 2009/0290720 A1 Nov. 26, 2009

(30) Foreign Application Priority Data

Oct. 28, 2005 (GB) ..... 0521976.1

(51) Int. Cl.
*H04R 1/10* (2006.01)

(52) U.S. Cl. ..... 381/74; 381/80; 381/371; 381/384

(58) Field of Classification Search ..... 381/74, 381/80, 371, 71, 72, 370, 384
See application file for complete search history.

(56) References Cited

U.S. PATENT DOCUMENTS

| | | | | |
|---|---|---|---|---|
| 6,728,585 | B2 * | 4/2004 | Neoh | 700/94 |
| 7,010,332 | B1 * | 3/2006 | Irvin et al. | 455/575.2 |
| 2001/0049262 | A1 * | 12/2001 | Lehtonen | 455/41 |
| 2003/0130016 | A1 * | 7/2003 | Matsuura et al. | 455/569 |
| 2004/0107271 | A1 | 6/2004 | Ahn et al. | |
| 2005/0069146 | A1 | 3/2005 | Bum | |
| 2006/0147052 | A1 * | 7/2006 | Wikel et al. | 381/74 |

FOREIGN PATENT DOCUMENTS

| | | |
|---|---|---|
| EP | 1196007 | 4/2002 |
| WO | WO03/056790 | 7/2003 |

* cited by examiner

*Primary Examiner* — Minh-Loan T Tran
*Assistant Examiner* — Fazli Erdem
(74) *Attorney, Agent, or Firm* — MacMillan, Sobanski & Todd, LLC

(57) ABSTRACT

An audio system comprises at least one pair of wireless headphones having an active operating mode and an inactive operating mode, the at least one pair of headphones comprising a solid-state audio player, a rechargeable battery, means for connecting to a computer, means for charging the battery, and a motion sensor, wherein the motion sensor detects movement of the headphones and causes headphones to be put into inactive mode when no motion is detected for a certain period of time and causes headphones to be put back into active mode when motion is detected.

24 Claims, 3 Drawing Sheets

AUDIO SYSTEM

FIELD OF THE INVENTION

The invention relates to an audio system, in particular to an audio system for use both in the home and school environment.

BACKGROUND OF THE INVENTION

Teachers often use audio systems in class as part of a lesson. This may form part of a language lesson, or for younger children, simply an audio story. The whole class is not always involved in the audio activity so often a teacher will use an audio system with headphones for each of the children.

Existing audio systems in schools are often mains powered tape players. Those participating in the audio activity listen via a loudspeaker, or wear headphones which are attached by a wire to the audio playback device. Even when using headphones, each child must listen to the same story at the same time. As well as being limited to the location of the device, the headphone wires can become tangled and this presents a hazard in classroom environment Mechanical robustness can be a problem with existing audio systems, especially with systems for use by small children. They may pull at the wire connecting the headphones to the tape player, or drop the headphones for example, causing damage.

Battery powered headphones for use with audio systems do exist, but a problem with these, especially with young children, is that children forget to turn them off after use resulting in battery power quickly draining.

It would be desirable to provide an improved audio system.

SUMMARY OF THE INVENTION

One aspect of the invention provides an audio system as specified in Claim 1.

Preferred aspects of the invention are specified in the claims dependent on Claim 1.

The invention provides an improved audio system for use either in a home or school environment. The system uses rechargeable wireless headphones, each with an in-built digital audio player and an automatic on/off control feature so that headphones are automatically switched into a low power mode when not in use. The invention also provides a wireless remote control console for use with multiple sets of headphones.

BRIEF DESCRIPTION OF THE DRAWINGS

In the drawings, which illustrate preferred embodiments of the invention.

DETAILED DESCRIPTION OF THE PREFERRED EMBODIMENTS

Figure 1:
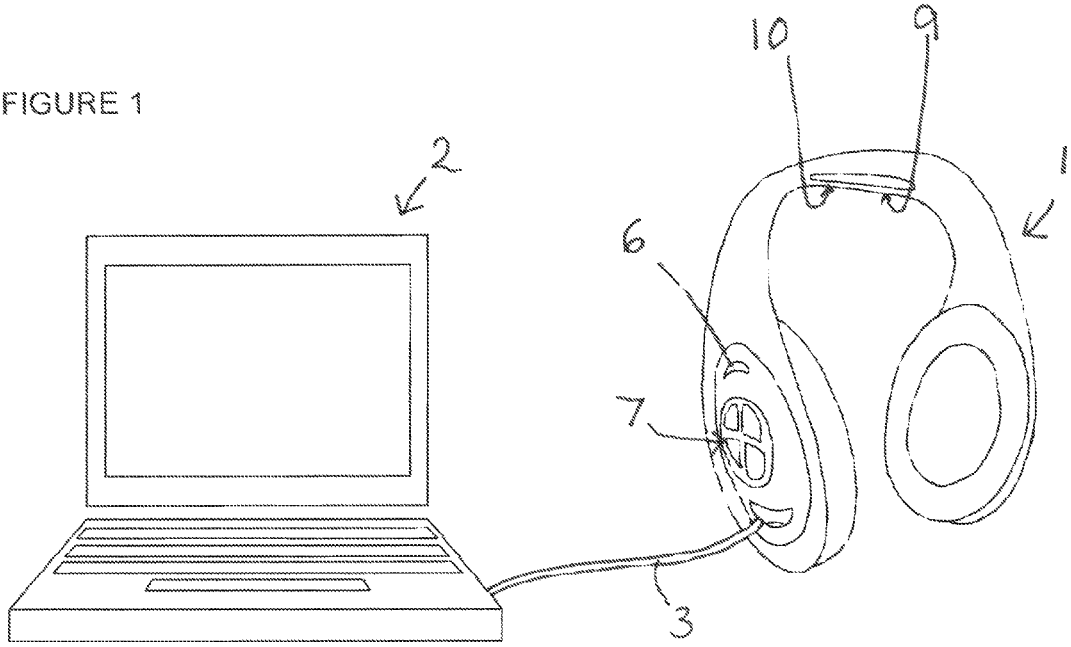
FIG. 1 shows one set of headphones connected to a computer.

The system of the invention is shown in its simplest form in FIG. 1. The system comprises a pair of headphones 1, which are connectable to a personal computer 2 via a cable 3, for example a standard USB cable. Headphones 1 also comprise a rechargeable battery which is recharged by the computer via the USB cable. An LED indicator light 6 indicates the status headphones 1. Headphones 1 have an in-built solid state audio player. Solid state audio players use digital audio compression algorithms to compress digital audio files. In this example the audio player is an mp3 player which uses an mp3 compression algorithm. Other compression algorithms are widely available such as wma (windows media audio), aac (advanced audio coding).

Figure 2:
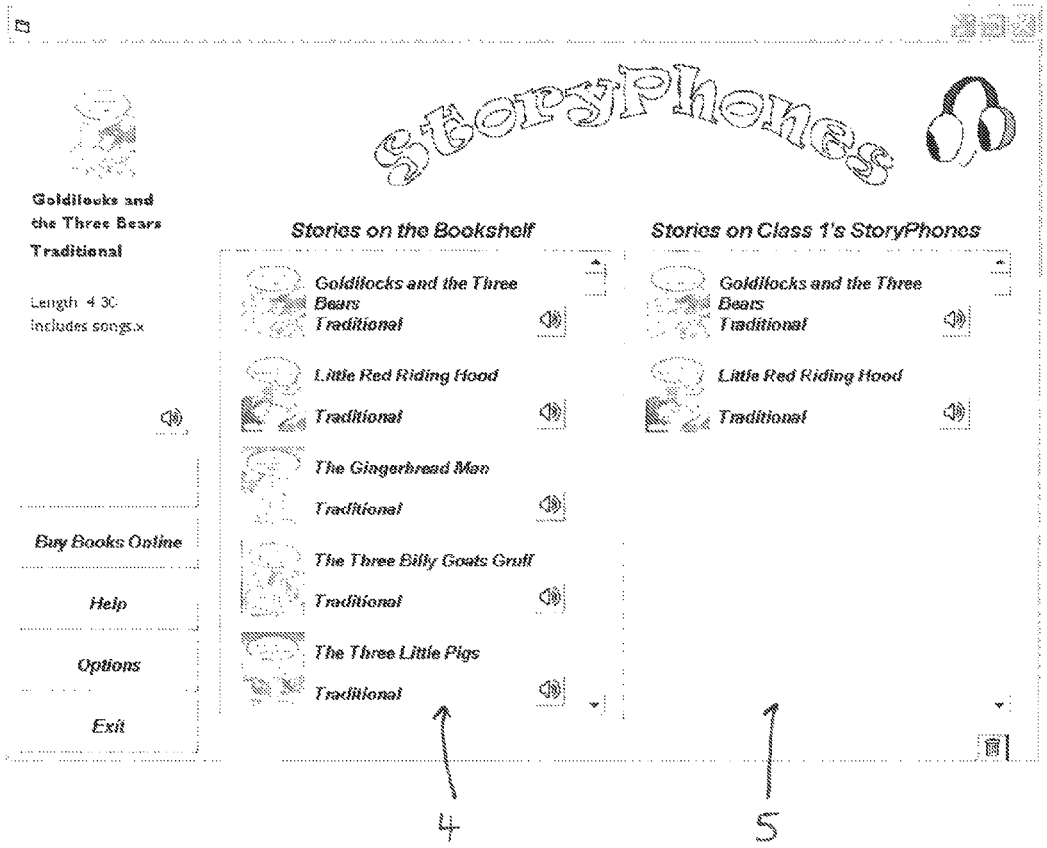
FIG. 2 shows a screen-shot of the software for use with the audio system.

The computer 2 is provided with software, which provides an interface for downloading audio files stored on computer 2 onto the mp3 player of the headphones 1. Audio files may be for example children's stories or listening games. The software also provides an interface to the internet to allow users to purchase and download audio files to computer 2. A screen-shot of the software is shown in FIG. 2. Audio files saved on computer 2 are shown on the left hand side 4 of the screen, and audio files transferred to the solid state mp3 player of headphones 1 are shown on the right hand side 5 of the screen. Audio files are transferred from computer 2 to headphones 1 by any appropriate file transfer method, for example 'dragging and dropping' the required file from the list on left hand side 4 to right hand side 5, or clicking on a button which commands the transfer of the required file.

Once the batteries are charged and audio files downloaded, headphones 1 are disconnected from computer 2. A user wears the headphones and listens to the downloaded audio files independently from computer 2.

Headphones 1 have a series of control buttons 7. These buttons allow the user to play or pause an audio file, skip to the next audio file, and may allow the user to control the volume. Where the system of the invention is to be used by small children, fewer control buttons on each headphone is desirable. In an alternative embodiment, for use with very small children, headphones 1 may have no control buttons at all.

Headphones 1 do not have an on/off control button. Instead, headphones 1 have two states of operation, an active mode where audio is played to the user, and an inactive mode or sleep mode where no audio is played. Headphones have an in-built motion sensor and a controller to control switching between these two states. In this example the controller is a micro-processor.

When headphones 1 are not in use, for example when they are set down on a table, after a set period of time the headphones will power down into the inactive mode to conserve battery. This period may be, for example, a period of twenty seconds during which no motion is detected. When headphones 1 are picked up again or moved, the motion detector detects this motion and headphones 1 are switched back into active mode. Once back in active mode, the headphones may be configured to rewind the audio track for the period of delay so that play of the audio track is continuous.

The motion sensor may be a tilt sensor or a vibration sensor and is very sensitive to movement. Even when a child is sitting still listening to a story, they will continually make slight movements and will not be completely still for the set period of say twenty seconds and the headphones will remain in active mode.

Figure 3:
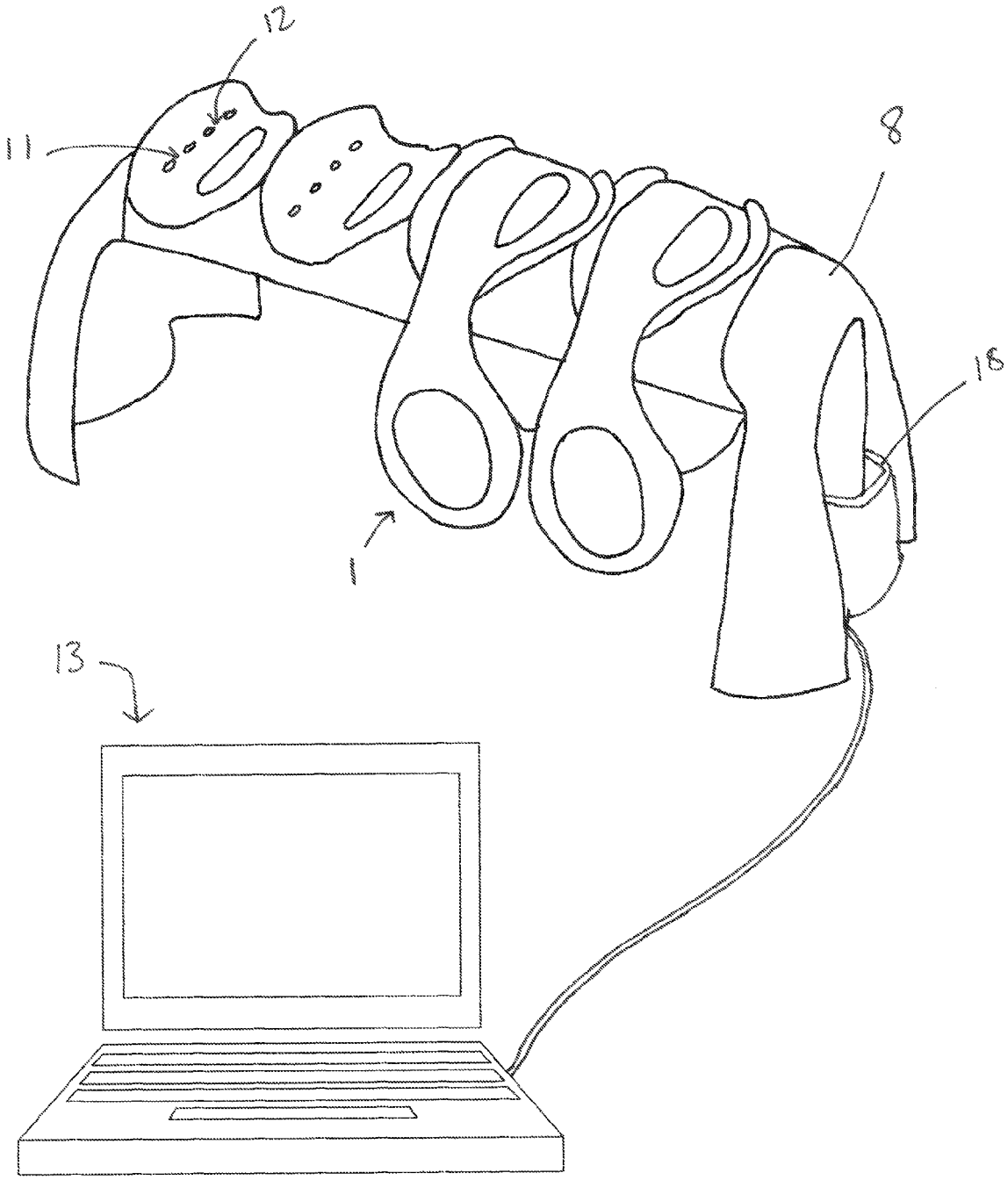
FIG. 3 shows multiple sets of headphones connected to a computer via a base unit.

In a school environment, the teacher is likely to have more than one set of headphones 1 for use with the pupils during lessons. FIG. 3 shows a base unit 8 that can be used to recharge the batteries of a number of sets of headphones 1 simultaneously. In the present example the base unit 8 is used to recharge four sets of headphones 1 simultaneously. Base unit 8 connects to the mains power to recharge headphones 1.

Base unit 8 is also connectable to a personal computer 13, for example via a USB cable, to enable audio files to be transferred to each set of headphones 1. Headphones 1 connect with connectors 11 and 12 on base unit 8 via equivalent connectors 9 and 10 on the underside of the headband of headphones 1. Connectors 11 enable the batteries of headphones 1 to be recharged and connectors 12 connect the mp3 player of headphones 1 to computer 13. Computer 13 is provided with software as previously described. The software has the option of transferring identical audio files to all headphones, or separate files to each set of headphones 1.

In an alternative embodiment, batteries of headphones 1 may be charged wirelessly using electromagnetic induction. Audio files may be downloaded onto headphones 1 by wireless transmission, for example this may be via infrared or radio frequency transmission or electromagnetic coupling.

Figure 4A:
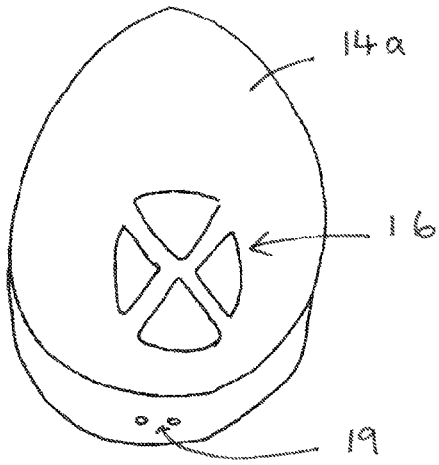
FIGS. 4*a, b* and *c* each illustrate a remote control console.

With reference to FIGS. 4*a, b* and *c*, in a school environment a teacher may also wish to use a remote control console 14*a, b* or *c* in order to remotely control a set of headphones 1. Remote control of the headphones is achieved by wireless transmission from remote console 14*a, b* or *c* to headphones 1. Wireless transmission may be performed using infrared or radio frequency, means.

Consoles 14*a, b* and *c* each comprise a wireless transmitter, for example a radio frequency transmitter. Headphones 1 for use with console 14*a, b* or *c* additionally comprise a wireless receiver, for example a radio frequency receiver. Consoles 14*a, b* or *c* are each powered by rechargeable batteries. The batteries may be recharged in base unit 8 by placing the console in pocket 18. Connector 19 on the console connects with an equivalent connector within pocket 18 on base unit 8 to enable the console to be recharged.

In its simplest form, as shown in FIG. 4*a*, console 14*a* comprises playback controls 16 which allow the teacher to play or pause a track, to stop a track, to reset or select first track and to skip to the next audio track.

Figure 4B:
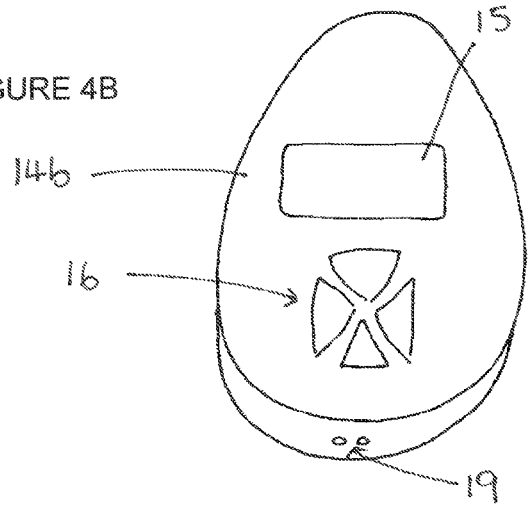

In a further embodiment, shown in FIG. 4*b*, console 14*b* comprises a display screen 15 in addition to playback controls 16. Two-way communication between console 14*b* and headphones 1 allows information from the headphones to be displayed on display screen 15 of console 14*b*. Information displayed may include a list of the available audio files saved on headphones 1; the time elapsed of the track that is playing; or an indicator of the battery life of individual headphones 1. To allow two-way communication headphones 1 additionally comprise a wireless transmitter, for example a radio frequency transmitter, and console 14*b* comprises a wireless receiver, for example a radio frequency receiver.

Figure 4C:
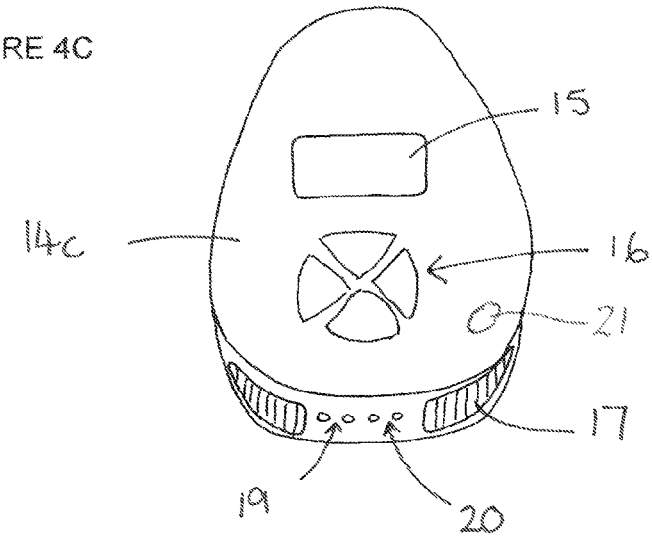

In a further embodiment, shown in FIG. 4*c*, console 14*c* has an in-built solid state audio player, for example an mp3 player and a loud speaker 17 in addition to the features described in relation to console 14*b*. This gives a teacher the option to play audio files through speaker 17 for group listening. In this embodiment, console 14*c* is also connectable to a computer 13 to enable audio files to be downloaded from computer 13 to the mp3 player of console 14*c* via the software interface. Console 14*c* connects to computer 13 is via base unit 8. Connector 20 on console 14*c* connects with an equivalent connector within pocket 18 on base unit 8 to allow programming of the audio player. In an alternative embodiment console 14*c* connects to computer 13 via wireless transmission.

In a further embodiment of the invention the console 14*c* includes a microphone 21 through which an audio signal generated by a user of the console 14*c* may be recorded. The sound signal is recorded to the console 14*c* and may be uploaded to the computer and stored as sound files by the computer software when the console 14*c* is connected to the computer 13.

Use of any of consoles 14*a* to *c* is not limited to a classroom. Consoles and headphones are battery powered and may be used anywhere, for example outside in the playground.

Headphones 1 may be configured to work in either 'local' mode, whereby each set of headphones 1 function independently of console 14 and each child may listen to a different story. Alternatively they may be configured to work in 'console' mode, whereby each set of headphones 1 is controlled by console 14 and each child listens to the same story. The mode of operation may be set by a switch on each pair of headphones 1, or in an alternative embodiment, the mode of operation may be selected as an option through the computer software when headphones are connected to computer 13. The computer software may be arranged to provide a function to switch off the control buttons 7 of the headphones. This allows incorrect use of the buttons 7 to be prevented. As children are apt to fiddle with the buttons 7 the ability to disable them is perceived as an advantage.

The audio system of the invention is suitable for both use in a home environment and use in a school environment.

It is envisaged that the software of the system will initially include a number of audio files. Teachers or home users may then purchase further audio files by downloading from an internet site, or purchasing additional files on a CD-ROM for example. It is also envisaged that schools may be able to 'rent' audio files for a certain period of time from an online audio file library.

In an alternative embodiment of the invention, users may subscribe to an online database, and the computer software automatically connects to the internet to download new files. When headphones 1 are connected to the user's computer via the software interface, these new files are automatically transferred to the headphones.

It will be appreciated that the system of the invention is not limited to use with young children, and maybe configured for use for example with music audio files, or audio files for use in language lessons for older children.

The invention claimed is:

1. An audio system comprising:

at least one pair of wireless headphones having an active mode and an inactive mode, the at least one pair of headphones including a solid-state audio player, a power source, a controller, means for connecting to a computer, and means for detecting movement of the headphones, wherein the controller causes the headphones to be put into inactive mode when no movement is detected for a certain period of time and, when movement is detected, the controller causes the headphones to be put back into active mode and further causes the audio player to rewind for the period of time during which no movement was detected.

2. An audio system as claimed in claim 1 wherein the audio player uses a compression algorithm selected from the group comprising MP3, WMA, and AAC.

3. An audio system as claimed in claim 1 wherein the inactive mode is a sleep mode.

4. An audio system as claimed in claim 1 wherein the means for detecting movement is a motion sensor.

5. An audio system as claimed in claim 4 wherein the motion sensor is a vibration sensor.

6. An audio system as claimed in claim 4 wherein the motion sensor is a tilt sensor.

7. An audio system as claimed in claim 1 wherein the controller is a microprocessor.

8. An audio system as claimed in claim 1 further including computer software for downloading audio files to the audio player of the or each pair of headphones.

9. An audio system as claimed in claim 8 wherein the computer software automatically connects to the internet and automatically downloads audio files.

10. An audio system as claimed in claim 1 wherein the means for connecting to a computer is a USB cable.

11. An audio system as claimed in claim 1 wherein the means for connecting to a computer is via wireless transmission.

12. An audio system as claimed in claim 1 wherein the power source is a rechargeable battery and the at least one pair of headphones further includes means for charging the battery.

13. An audio system as claimed in claim 12 wherein the means for charging the battery is a USB cable connected to a computer.

14. An audio system as claimed in claim 12 wherein the means for charging the battery is a base unit that includes means for connecting the base unit to a power supply and means for connecting at least one pair of headphones to the base unit.

15. An audio system as claimed in claim 1 further including a remote control console that includes a wireless transmitter for transmitting signals to the at least one pair of headphones and a power source, the at least one pair of headphones further including a wireless receiver.

16. An audio system as claimed in claim 15 wherein the power source is a rechargeable battery.

17. An audio system as claimed in claim 15 wherein the at least one pair of headphones further comprising a wireless transmitter and the remote control console further comprising a wireless receiver.

18. An audio system as claimed in claim 15 wherein the remote control console further includes a display screen.

19. An audio system as claimed in claim 15 wherein the remote control console further comprising a solid-state audio player, a loud speaker, and means for connecting to a computer.

20. An audio system as claimed in claim 15 wherein the wireless transmitter is a radio frequency transmitter and the wireless receiver is a radio frequency receiver.

21. An audio system as claimed in claim 15 wherein the wireless transmitter is an infra red transmitters and the wireless receiver is an infra red receiver.

22. An audio system as claimed in claim 15 wherein the at least one pair of headphones has a console operating mode and a local operating mode and the system comprising means for switching between the console and local operating modes.

23. An audio system as claimed in claim 22 wherein the remote control console is used to remotely control the at least one pair of headphones set to operate in console operating mode.

24. An audio system as claimed in claim 15 wherein the remote control console includes a microphone and a record function.

* * * * *